United States Patent [19]

Vickery

[11] 4,040,522

[45] Aug. 9, 1977

[54] MAGAZINE RACK

[76] Inventor: Warren J. Vickery, 7 Fox Run, Armonk, N.Y. 10504

[21] Appl. No.: 684,309

[22] Filed: May 7, 1976

[51] Int. Cl.[2] ..... A47G 29/00

[52] U.S. Cl. ..... 211/88; 211/126; 248/205 A

[58] Field of Search ..... 211/88, 86, 87, 189, 211/126; 248/205 A; 85/83, 84; 46/27, 29

[56] References Cited

U.S. PATENT DOCUMENTS

| | | | |
|---|---|---|---|
| 2,261,786 | 11/1941 | Vincent | 211/86 |
| 2,679,998 | 6/1954 | Keller | 248/205 A |
| 2,718,809 | 9/1955 | Kraft | 85/83 |
| 3,333,722 | 8/1967 | Panknin | 211/126 X |
| 3,489,385 | 1/1970 | Dill | 211/88 X |
| 3,637,181 | 1/1972 | Janssen | 248/205 A |
| 3,647,077 | 3/1972 | Gillespie | 211/126 |
| 3,647,306 | 3/1972 | Chamberlin | 85/84 X |
| 3,813,813 | 6/1974 | Powell | 211/88 X |

FOREIGN PATENT DOCUMENTS

| | | | |
|---|---|---|---|
| 401,395 | 5/1966 | Switzerland | 211/88 |

*Primary Examiner*—Roy D. Frazier
*Assistant Examiner*—Robert W. Gibson, Jr.
*Attorney, Agent, or Firm*—Allen D. Brufsky

[57] ABSTRACT

A magazine rack for holding magazines includes a base, an open top frame, and a number of elongated space members extending between the base and opened top frame. Bracket members are adhesively secured to a wall, wherein the bracket members engage the opened top frame.

5 Claims, 3 Drawing Figures

MAGAZINE RACK

BACKGROUND OF THE INVENTION

A number of U.S. patents relate to various designed racks, U.S. Pat. No. 2,807,371 to Johnson relates to a table-like rack holder. U.S. Pat. No. 2,979,120 to Amburn relates to a detachable book rack for folding chairs. U.S. Pat. No. 3,570,677 to George relates to a book holder having a specially designed ejector means. U.S. Pat. No. 3,747,776 to Cross relates to a detachable pocket member which is secured to a wall.

SUMMARY OF THE INVENTION

My present invention relates to a unique and novel magazine rack which is detachably secured to a wall.

An object of my present invention is to provide a magazine rack which is readily disassembled for storage.

A still further object of my present invention is to provide a novel means for securing the magazine rack to a wall.

Another object of my present invention is to provide an opened wall magazine rack thereby allowing easy viewing of the magazine in the rack.

Briefly, my present invention comprises a base, an open top frame, and a number of elongated space members extending between the base and opened top frame. Bracket members are adhesively secured to a wall, wherein the bracket members engage the opened top frame.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
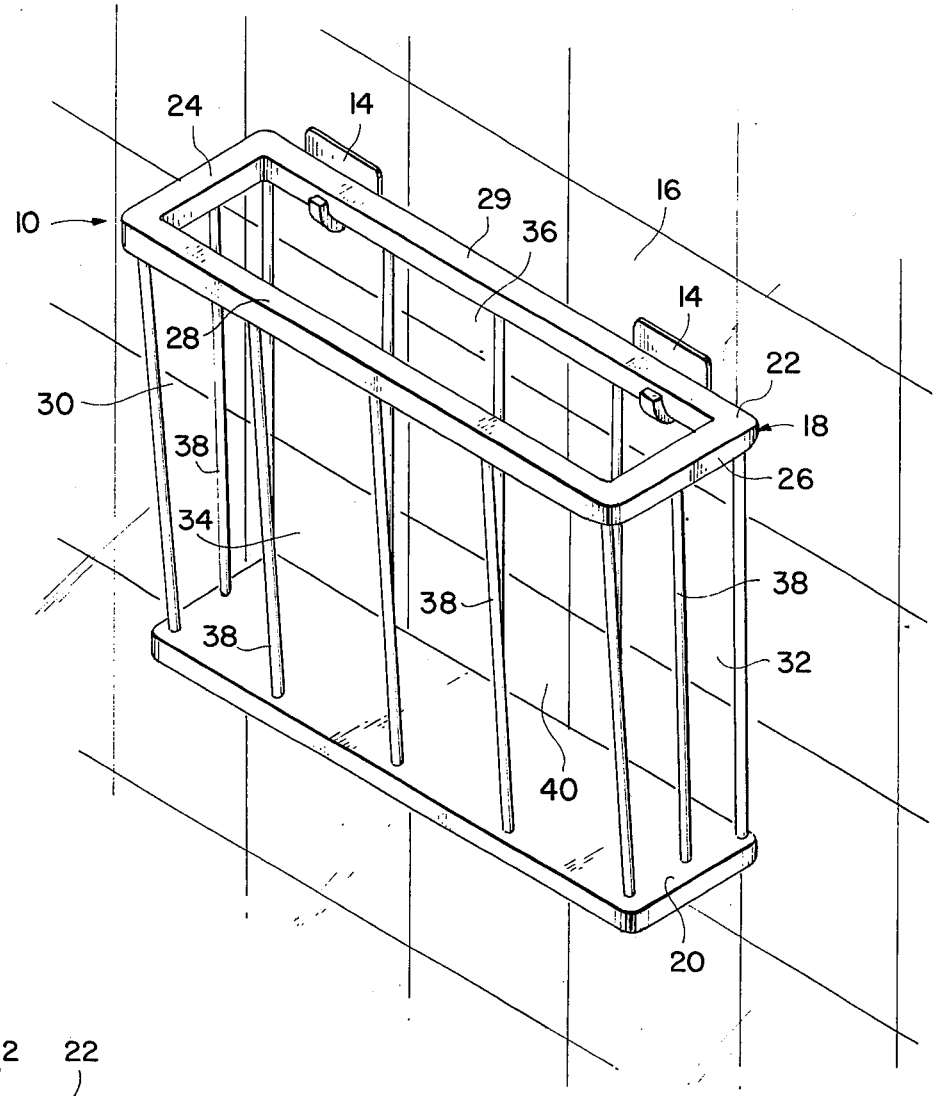
FIG. 1 illustrates a perspective view of a magazine rack.

Turning now descriptively to the drawings, in which similar reference characters denote similar elements through out the several views, FIG. 1 shows a magazine rack 10 adapted to receive a plurality of magazines 12, not shown, therein, wherein the rack is adapted to be suspended on a plurality of bracket members 14. The bracket members 14 are adapted to be detachably mounted on a wall 16. The rack 10 comprises a housing 18 having a rectangularly shaped base 20; a top 22 formed in the shape of a rectangularly shaped frame having a pair of end sections 24, 26, a front section 28, and a rear section 29; and a pair of opened end walls 30, 32, a forward opened wall 34, and an opened rear wall 36, wherein each wall 30, 32, 34, 36 is formed from a plurality of elongated cylindrically shaped elements 38 which are arranged in a space relationship to each other. Each element 38 communicates between the base 20 and top 22 thereby defining a chamber 40 within the rack 10. The magazines 12 are inserted into chamber 40 through the opened top frame 22.

Figure 2:
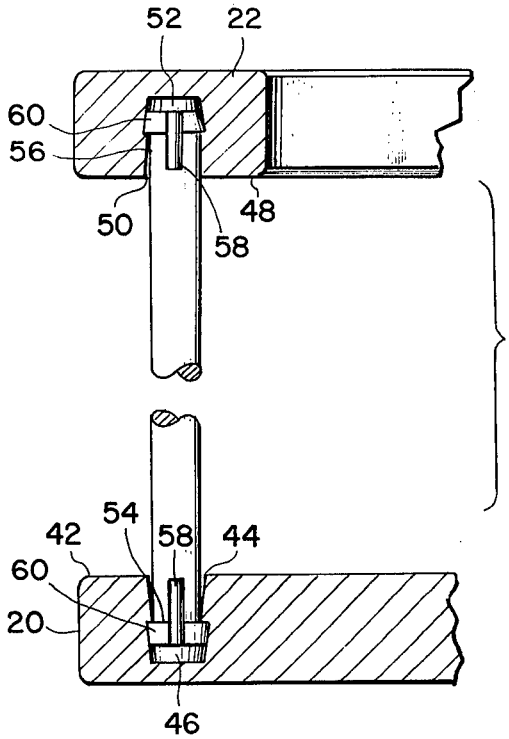
FIG. 2 illustrates a cross sectional view of a section of the magazine rack.

FIG. 2 shows the mounting means for joining each element 38 to both the top frame 22 and base 20. The upper surface 42 of the base 20 has a plurality of holes 44 therein, wherein the holes 44 are evenly spaced along the entire peripheral edge of the base 20. A first snap element 46 is disposed within each hole 44. The bottom surface 48 of the top frame 22 has a plurality of apertures 50 therein. A second snap element 52 is disposed within each aperture 50. Each end 54, 56 of each element 38 has an opening 58 therein. A bifurcated ring shaped element 60 formed from a rubber like material is affixed to each end 54, 56 of each element 38. Each snap elements 46, 52 inserts through one element 60 into one opening 58, wherein element 60 frictionally engages onto one of elements 46, 52 and frictionally engages the inner wall of the hole 44 or aperture 50.

Figure 3:
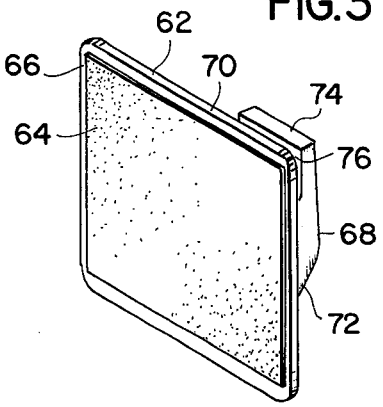
FIG. 3 illustrates a rear perspective view of a bracket member used to secure the magazine rack to a wall.

FIGS. 1, 3 show the bracket member 14 which includes a rectangularly shaped plate 62 having a pressure sensitive adhesive layer 64 coated on the rear surface 66 of plate 62. An L-shaped member 68 is affixed to front face 70 of plate 62, wherein one arm 72 of member is perpendicularly joined to face 70 thereby disposing the other arm 74 in an upwardly vertical alignment and creating an air gap 76 between arm 74 and face 70. The rear section 29 of top 22 is received into air gap 76 and section 29 rest on top of arm 72.

As shown in FIG. 1, the depth and width of the top 22 is greater than the base 20 thereby causing each wall 30, 32, 34, 36 to be slanted inwardly from the top 22 to the base 20.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A magazine rack for receiving magazines therein, which comprises:

a. an opened top frame;

b. a base;

c. a plurality of elongated elements;

d. means for joining each said elongated element to said base and said top frame, wherein said elongated elements are spaced apart from each other to create a plurality of upwardly extending walls having a plurality of elongated openings therethrough, said joining means including, a bifurcated rubber ring member affixed to each end of said elongated element, each said end having an opening therein, a first snap element disposed in each of a plurality of holes in an upper surface of said base, one of said snap elements received through a first bifurcated ring member into a first opening in each of said elongated elements, and a second snap element disposed in each of a plurality of apertures in a lower surface of said top frame, one of said second snap elements received through a second bifurcated ring member into a second opening in each said of elongated elements; and e. means for securing said rack to a vertical surface.

2. A rack according to claim 1, wherein each said elongated element is cylindrical shaped.

3. A rack according to claim 1, wherein said base and said top frame are rectangularly shaped.

4. A rack according to claim 1, wherein said means for securing further comprises a bracket member and means for detachably anchoring said bracket member to said vertical surface.

5. A rack according to claim 4 wherein said means for anchoring is an adhesive layer.

* * * * *